United States Patent [19]

Owens et al.

[11] Patent Number: 4,704,091

[45] Date of Patent: Nov. 3, 1987

[54] CONNECTOR SYSTEM

[76] Inventors: Rick L. Owens, 3078 Thunder Bay Rd., Little Canada, Minn. 55117; Michael J. Fowler, 649 Jefferson Ave., St. Paul, Minn. 55102

[21] Appl. No.: 876,098

[22] Filed: Jun. 19, 1986

[51] Int. Cl.[4] ..... H01R 13/405; H01R 13/504; H01R 43/24

[52] U.S. Cl. ..... 439/281; 439/282; 439/491; 439/592; 439/597; 439/606

[58] Field of Search ..... 339/60 R, 60 M, 61 R, 339/61 M, 113 R, 218 R, 218 M, 59 R, 59 M, 60 C, 61 C

[56] References Cited

U.S. PATENT DOCUMENTS

| | | | |
|---|---|---|---|
| 2,677,115 | 4/1954 | Stevens | 339/60 M |
| 3,121,598 | 2/1964 | Marasco | 339/60 R |
| 3,573,713 | 4/1971 | Enright et al. | 339/113 R X |
| 3,842,393 | 10/1974 | Glover et al. | 339/60 M |
| 4,202,351 | 5/1980 | Biche | 339/113 R X |
| 4,571,017 | 2/1986 | Fujita | 339/59 M |
| 4,632,121 | 12/1986 | Johnson et al. | 339/60 R X |

*Primary Examiner*—Gil Weidenfeld
*Assistant Examiner*—Steven C. Bishop
*Attorney, Agent, or Firm*—Hugh D. Jaeger

[57] ABSTRACT

Connector system such as for medical applications, which includes a yoke with inset pins, the yoke also including a locking feature for mating with an insulated connector, and locking the insulating connector into the yoke. The yoke includes at least one or a plurality such as three or more inset pins in the yoke for receiving insulated connectors such as for breath, heartbeat, and rate monitors. The yoke is formed in a three step molding process where colored buttons are first molded, the buttons and pins are then molded into a small inner yoke body assembly, and then a final yoke assembly is molded encompassing the pins, buttons, informational plaque, including a strain relief for the cable. The connector system provides for safety as well as FDA considerations and prevents a connecting lead being plugged into an AC outlet.

4 Claims, 5 Drawing Figures

CONNECTOR SYSTEM

BACKGROUND OF THE INVENTION

1. Field of the Invention

The present invention pertains to a connector system, and more particularly, pertains to a medical connector system for use with medical monitors providing for pins which are inset inside a yoke and including a locking feature for locking an insulated connector within the yoke thereby providing the safety feature of non-exposed electrical pins and insulated connectors.

2. Description of the Prior Art

The prior art medical connectors have usually utilized connecting leads which have had pins on both ends and which have been less than desirable in that youngsters would sometimes plug one of the connector pins into an AC wall socket and then might subsequently connect the remainder pin to their own body, causing severe injury or death. This was particularly true with infant monitors or other like medical monitors. The prior art failed to provide for connector leads which were safe and FDA approved, and so that electrocution would be prevented.

The present invention overcomes the disadvantages of prior art by providing a connector system, particularly a yoke, which includes the use of inset pins in an insulated yoke. The yoke which provides for insulation about the pins also provides a self locking feature for insulator connections for each of the pins. This also provides inherent safety where the pins are surrounded by an insulated yoke.

SUMMARY OF THE INVENTION

The general purpose of the present invention is to provide a connector system, particularly for medical applications, which incorporate a yoke with pins positioned inside and surrounded by said yoke, and including a locking feature for a subsequent insulated connector which engages and locks therein about each pin.

According to one embodiment of the present invention, there is provided a molded yoke including at least one and preferably a plurality such as three or more pins molded therein such as in line, annular rings molded in yoke about and in proximity to a mid portion of each of the pins, labeling dots molded into the yoke, information plaques molded into the yoke; and, an insulated lead including a connector, insulation surrounding the connector, and forward of the end of the connector, including an annular lip surrounding the outer insulated end of the connector for locking engagement with the annular ring of the yoke.

Significant aspects and features of the connector system of the present invention include a yoke with insulation surrounding the inset pins. The yoke also includes a plurality of information dots, preferably colored coded, molded adjacent each contact pin hole. There is also provided a molded contact pin dot information plaque in the yoke.

Another significant aspect and feature of the present invention is a connector system with an insulated connector lead which provides safety to the user.

Having thus described embodiments of the present invention, it is the principle object hereof to provide a connector system for medical applications, the connector system including a yoke with inset insulated pins thereon and for accepting insulated connector leads.

BRIEF DESCRIPTION OF THE DRAWINGS

Other objects and many of the attendant advantages of this invention will be readily appreciated, as the same becomes better understood by reference to the following description, when considered in connection with the accompanying drawings, in which like reference numerals designate parts throughout the figures thereof and wherein.

DESCRIPTION OF THE PREFERRED EMBODIMENTS

Figure 1:
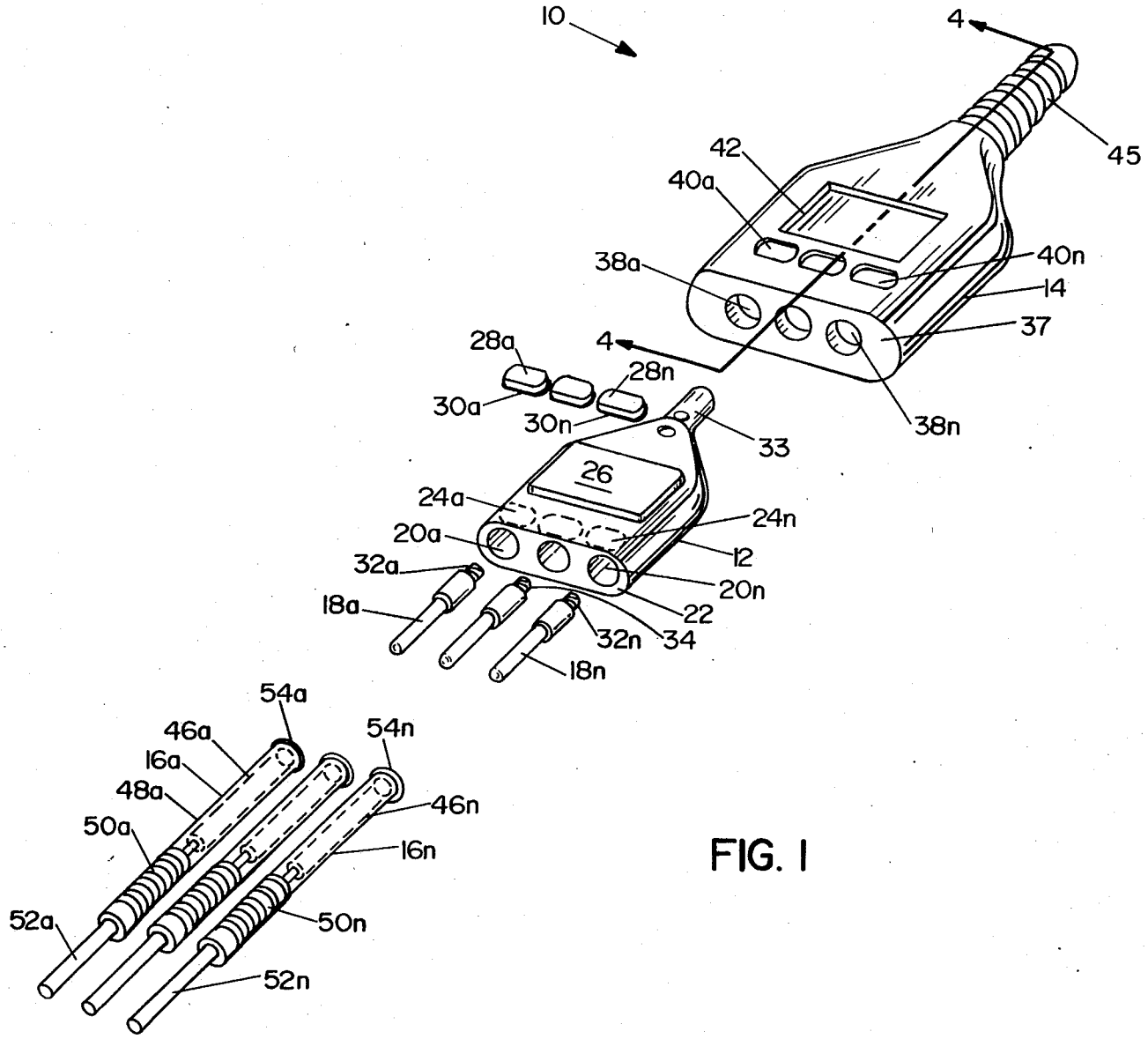
FIG. 1 illustrates an exploded perspective view of components of a connector system, the present invention.
Figure 3:
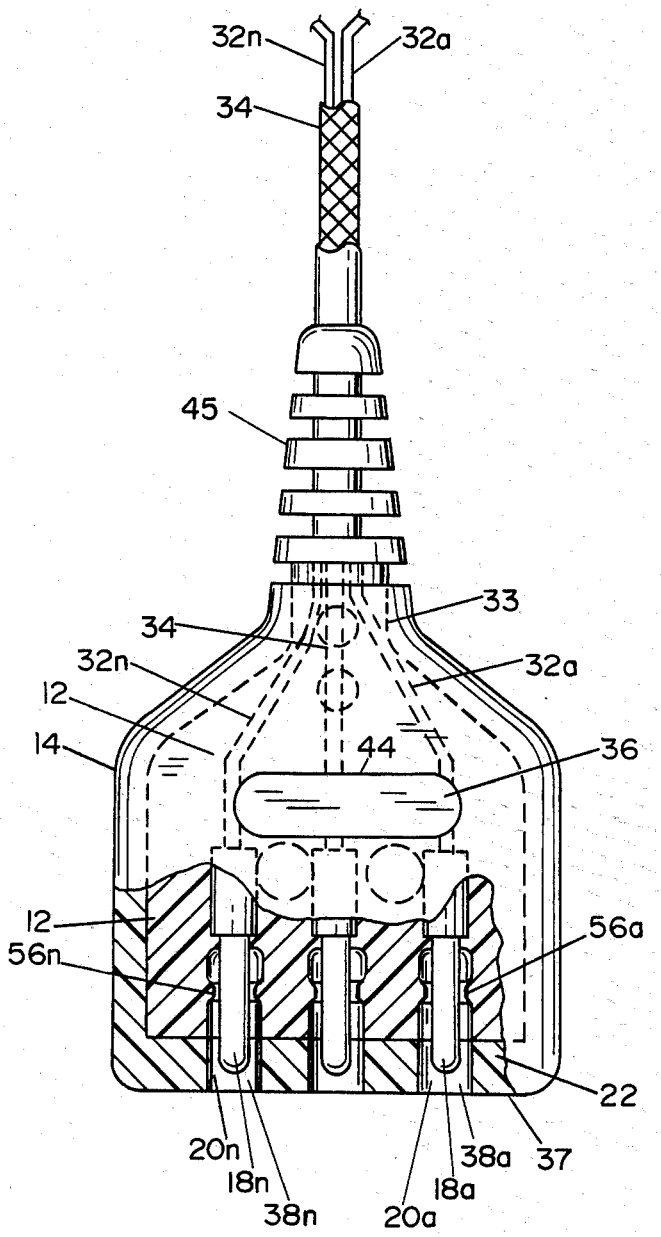
FIG. 3 illustrates a partially cutaway section of a bottom view of the connector system.

FIG. 1 illustrates an exploded perspective view of a connector system, the present invention, 10 for use such as a medical connector. The molded connector system 10 includes an inner yoke 12, and an outer yoke 14 where the outer yoke 14 is molded over and about the inner yoke 12 by a molding process later described. A plurality of insulated connector leads 16*a*–16*n* connect to inset contact pins 18*a*–18*n* within the combination inner yoke 12 and outer yoke 14 structure of the connector system 10. The inner yoke 12 includes a plurality of cylindrical longitudinal holes 20*a*–20*n* with extending inwardly within a flat planar end 22. A raised planar member 26 positions as illustrated on the upper surface of the inner yoke 12. Color coded oval or like shaped labeling insert dots 28*a*–28*n* including lower ridges 30*a*–30*n* position during a molding process on respective areas 24*a*–24*n* as illustrated by dashed lines. Contact wires 32*a*–32*n* and ground wire 34 are routed through and molded into an end member 33. A raised elongated oval member 36 positions on the bottom surface of the inner yoke 12 as illustrated in FIG. 3. The molded outer yoke 14 includes an end 37, plug insert holes 38*a*–38*n* located in the end 37, oval insert holes 40*a*–40*n*, a rectangular hole 42 on the upper planar surface, an elongated oval hole 44 on the lower planar surface, and a cable strain relief member 44 positioned opposite end 37. Inner yoke 12 fits within and is entirely surrounded by molded outer yoke 14 as later explained in detail. The yoke has a "Y" or like shaped end configuration. Insulated leads 16*a*–16*n* include cylindrical inner connector surfaces 46*a*–46*n*, molded polymer bodies 48*a*–48*n*, cable strain relief 50*a*–50*n* and respective contact wires 52*a*–52*n* for connection to a body function monitoring system by way of example and for purposes of illustration only, and not to be construed as limiting of the present invention. Annular lips 54*a*–54*n* position about the ends of the insulated connector leads 16*a*–16*n* for positive snap action engagement within annular rings 56*a*–56*n* at mid portions in the holes 20*a*–20*n* of the inner yoke 12 as illustrated in FIG. 3.

Figure 2:
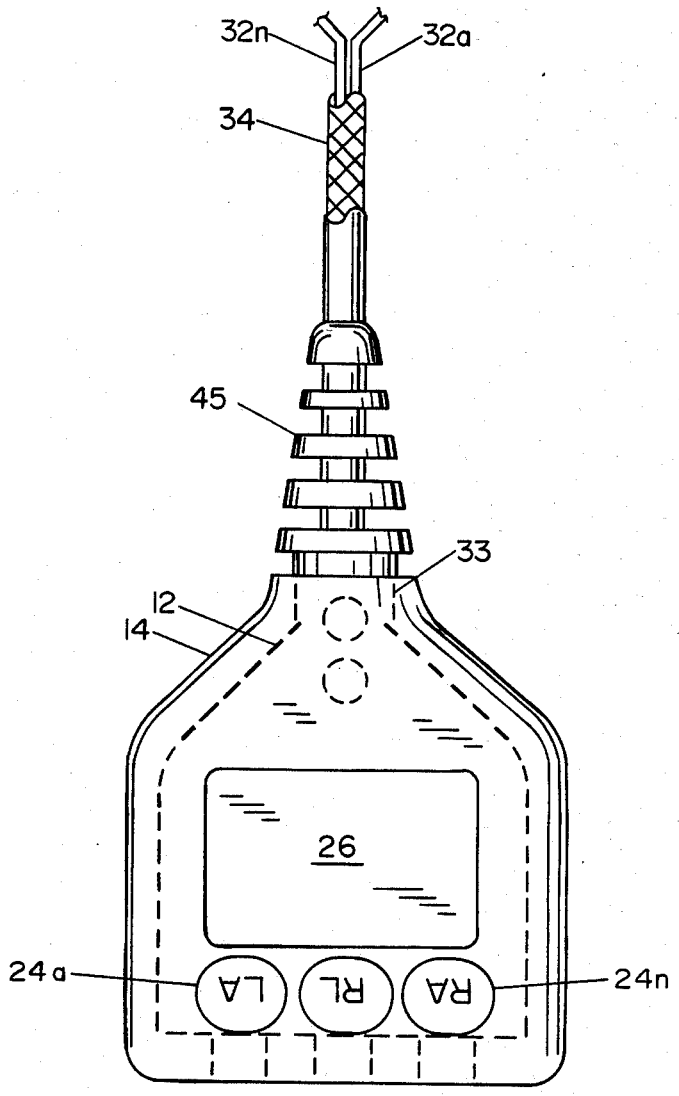
FIG. 2 illustrates a top view of the connector system.

FIG. 2 illustrates a top view of the medical connector 10. In particular, the placement of the inner yoke 12 within the outer yoke 14 is illustrated by dashed lines.

FIG. 3 illustrates a cut away bottom view of the connector system 10. Illustrated in particular are the contact pins 18a–18n molded concentrically within holes 20a–20n and 38a–38n of inner and outer yokes 12 and 14 respectively. Annular rings 56a–56n position in holes 20a–20n respectively for positive securing of insulated connector leads 16a–16n by engagement of annular lips 54a–54n as later described and illustrated in detail in FIG. 5.

Figure 4:
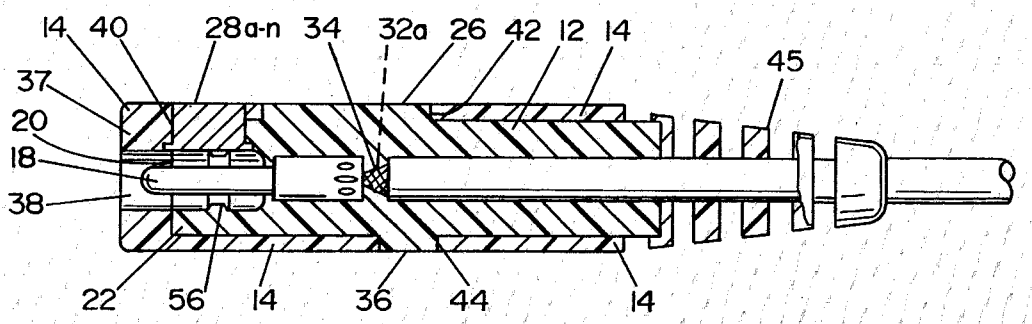
FIG. 4 illustrates a side view in cross section of the connector system taken along line 4—4 of FIG. 1; and, FIG. 5 illustrates a view in cross section of an insulated electrical connector lead engaged within a yoke of the connector system.

FIG. 4 illustrates a side view in cross section of the connector system 10 taken along line 4—4 of FIG. 1. Illustrated in particular is the surroundation and encapsulation of inner yoke 12, and the color coded alpha numeric insert dots 28a–28n by the outer yoke 14. The ridges 30a–30n of the inserts 28a–28n are mechanically and physically secured beneath the surfaces of the yoke 12 inner mold and the yoke 14 outer mold. Raised planar member 26 engages within rectangular hole 42, and the elongated oval member 36 engages within hole 44 of the outer yoke 14 for positive mechanical positioning and securing of the inner yoke 12 within the outer yoke 14. End member 37 an integral member of the outer yoke 14 position over the end 22 of the inner yoke 12 for further mechanical securement of the inner yoke 12 within the outer yoke 14.

Figure 5:
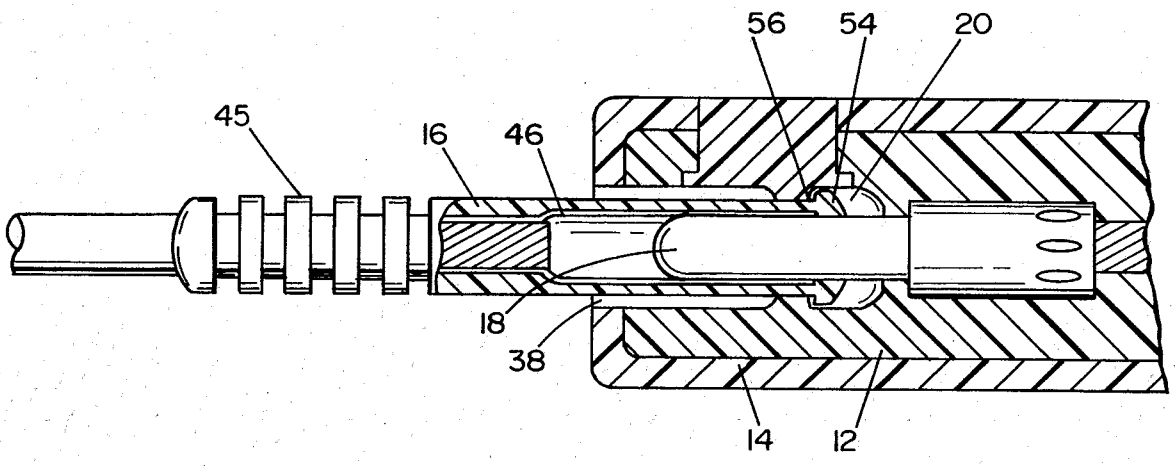

FIG. 5 illustrates a view in cross section of an insulated electrical connector lead 16 engaged within the molded yoke combination 12–14 of the medical connector 10. An insulated lead 16 is inserted into the hole 38 of the outer yoke 14 and engages with the contact pin 18. The lead 16 is inserted into hole 20. Flexible lip 54 then passes by and past annular ring 56 with a positive snap action and with digital sensory feedback, while being securely engaged within the inner most portion of hole 20. To disengage the insulated lead 16 from the contact pin 18, the lead 16 with the annular lip 54 is pulled outward with a moderate amount of force past the annular ring 56 providing a similar snap action with digital sensory feedback.

MODE OF OPERATION

FIG. 1 in conjunction with FIGS. 2–5 best illustrate the mode of operation and formation of the plug during the associated molding processes. During the first molding process, the contact pins 18a–18n and associated shielded contact wires 32a–32n including grounded shield wire 34 are molded into a polymer inner yoke body 12. The color and alpha-numeric coded inserts 28a–28n having been previously molded are also loaded into the mold for the inner yoke 12 with the associated components including contact pins 18a–18n, contact wires 32a–32n, and the ground shield 34. In forming outer yoke 14, a high grade polymer molding compound flows around and is molded to the inner yoke 12, around color coded alpha-numeric labeling inserts 28a–28n leaving the upper surface of the inserts 28a–28n exposed, around the raised planar informative plaque member 26, and around bottom elongated oval member 36 as illustrated in FIG. 3 also leaving their exterior surfaces exposed. Alpha-numeric color coded inserts 28a–28n are secured beneath the surface of inner yoke 12 by the placement of yoke molding material over the ridges 30a–30n of the inserts 28a–28n. The raised planar surface 26 essentially extends through rectangular hole 42 of the outer yoke 14 as does the elongated oval member 36 through the elongated oval hole 44 on the underside of the outer yoke body 14 for mechanical securement of the inner yoke 12 and associated components within the outer yoke member 14.

Molded insulated connector leads 16a–16n including cylindrical inner connector surfaces 46a–46n and flexible lips 54a–54n engage over contact pins 18a–18n and within annular rings 56a–56n with a forced positive snap action to insure a secure electrical engagement between the connector leads 16a–16n with the contact pins 18a–18n of the connector system 10 for subsequent monitoring of body functions and vital signs by peripheral monitoring equipment.

Various modifications can be made to the present invention without the departing from the apparent scope thereof.

We claim:

1. A connector system comprising:

a. a composite yoke having a molded inner yoke body of flexible insulating material, a molded outer yoke housing and a planar end face;

b. a plurality of holes extending inwardly from said planar end face, through said outer yoke housing and into said inner yoke body;

c. each of said holes having an internal annular shoulder portion in said inner yoke body serving to reduce the internal diameter of said hole at a point spaced from said planar end face;

d. a corresponding plurality of inset connector pins, each positioned coaxially within a respective one of said holes, supported by said flexible insulating material and extending through said annular shoulder to a point spaced inwardly from said planar end face;

e. said contact means inset inwardly from the end of said insulating member and configured to receive said connector pin; and, g. an annular lip about the end of said molded insulating member, said lip having an outer diameter permitting insertion into a selected of said holes whereby said lip passes beyond said annular shoulder to be retained thereby and hold said contact means in electrical contact with said connector pin.

2. System of claim 1 including coded information dot means molded into said outer yoke housing adjacent each of said holes.

3. System of claim 1 including information plaque means molded into said outer yoke housing.

4. Process for making a yoke connector comprising the steps of:

a. molding color coded buttons having raised lettering thereon;

b. molding an inner yoke body of flexible insulating material incorporating the color coded button of step (a) and a plurality of connector pins coaxial with a corresponding plurality of holes each having an inwardly extending annular shoulder surrounding each of said pins; and, c. molding an outer yoke housing incorporating an information plaque and the inner yoke body of step (b).

* * * * *